United States Patent [19]

Fu et al.

[11] Patent Number: 4,999,099

[45] Date of Patent: Mar. 12, 1991

[54] PROCESS FOR MAKING MESOPHASE PITCH

[75] Inventors: Ta-Wei Fu, Ponca City, Okla.; Manfred Katz, Wilmington, Del.

[73] Assignee: Conoco Inc., Ponca City, Okla.

[21] Appl. No.: 824,387

[22] Filed: Jan. 30, 1986

[51] Int. Cl.[5] ..... C10C 3/04

[52] U.S. Cl. ..... 208/39; 208/22; 208/44; 423/447.2; 423/447.4; 423/447.6; 264/292

[58] Field of Search ..... 423/447.2, 447.4, 447.6; 264/29.2; 208/22, 39, 44

[56] References Cited

U.S. PATENT DOCUMENTS

| | | | |
|---|---|---|---|
| 3,004,862 | 10/1961 | Winslow | 208/44 |
| 3,595,946 | 7/1971 | Joo et al. | 423/447.6 |
| 3,919,376 | 11/1975 | Schulz | 423/447.4 |
| 4,066,737 | 1/1978 | Romevacek | 264/29.2 |
| 4,184,942 | 1/1980 | Angler et al. | 423/447.4 |

FOREIGN PATENT DOCUMENTS

| | | | |
|---|---|---|---|
| 58-172142 | 4/1985 | Japan | 422/447.2 |
| 2115437 | 9/1983 | United Kingdom | 208/22 |

*Primary Examiner*—Olik Chaudhuri
*Assistant Examiner*—Robert M. Kunemund
*Attorney, Agent, or Firm*—C. R. Schupbach

[57] ABSTRACT

An improved process for producing an anisotropic pitch product suitable for carbon fiber manufacture. A carbonaceous feedstock is heated at elevated temperature while passing a reactive sparging gas through the feedstock. The sparging gas is an oxidative gas such as a gaseous mixture containing a major proportion of inert gas and from about 0.1 to 2% by volume of oxygen. The process produces an anisotropic pitch having from 50 to 100% by volume mesophase which is suitable for producing good quality carbon fibers.

15 Claims, 1 Drawing Sheet

FEED: HEAVY OIL FROM FCC
REACTOR CHARGE: ~200 GRAMS
HEAT-SOAK TEMP.: 385°C
SPARGING GAS: MIXTURE OF OXYGEN AND NITROGEN
SPARGING RATE: 1.75 $FT^3/HR$ (STANDARD CONDITIONS)
REACTOR PRESSURE: ATMOSPHERIC

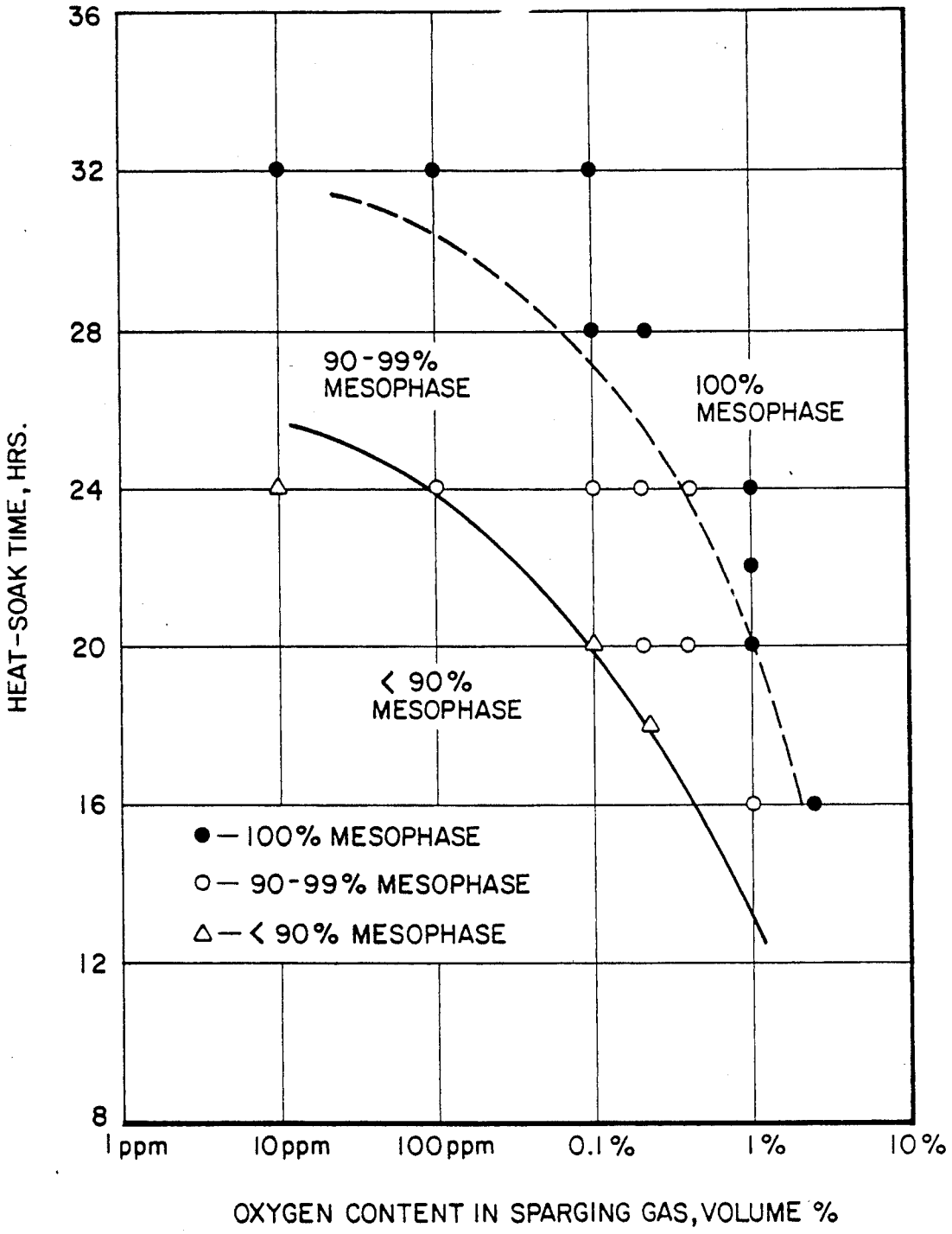
FEED: HEAVY OIL FROM FCC
REACTOR CHARGE: ~200 GRAMS
HEAT-SOAK TEMP.: 385°C
SPARGING GAS: MIXTURE OF OXYGEN AND NITROGEN
SPARGING RATE: 1.75 $FT^3$/HR (STANDARD CONDITIONS)
REACTOR PRESSURE: ATMOSPHERIC

PROCESS FOR MAKING MESOPHASE PITCH

BACKGROUND OF THE INVENTION

1. Field of the Invention

The present invention pertains to an improved process for producing a carbonaceous pitch product having a mesophase content ranging from about 50 to 100%, which is suitable for carbon fiber manufacture. More particularly, the invention relates to a process for making mesophase-containing pitch capable of producing carbon fibers having enhanced properties, by use of an oxidatively reactive sparge gas during heat treatment of mesophase precursor.

2. The Prior Art

In recent years extensive patent literature has evolved concerning the conversion of carbonaceous pitch feed material into a mesophase-containing pitch which is suitable for the manufacture of carbon fibers having desirable modulus of elasticity, tensile strength, and elongation characteristics.

U.S. Pat. No. 4,209,500 which issued to Chwastiak on June 24, 1980 is directed to the production of a high mesophase pitch that can be employed in the manufacture of carbon fibers. This patent is one of a series of patents pertaining to a process for producing mesophase pitches suitable for carbon fiber production. Each of these patents broadly involves heat treating or heat soaking the carbonaceous feed while agitating and/or passing an inert gas therethrough so as to produce a more suitable pitch product for the manufacture of carbon fibers.

As set forth in the Chwastiak patent, earlier U.S. Pat. Nos. 3,976,729 and 4,017,327 issued to Lewis et al involve agitating the carbonaceous starting material during the heat treatment. The use of an inert sparge gas during heat treatment is found in U.S. Pat. Nos. 3,974,264 and 4,026,788 issued to McHenry. Stirring or agitating the starting material while sparging with an inert gas is also disclosed in the McHenry patents.

The Chwastiak patent additionally discloses the prior state of the art, as well as the Lewis et al and McHenry patents discussed above, and these disclosures by Chwastiak in Column 1, line 13 to Column 2, line 50, are incorporated herein by reference. Both the Lewis et al and McHenry proposals to promote mesophase formation had serious limitations, according to Chwastiak, in that their pitch products tended to segregate into two phase systems which hampered subsequent spinning operations.

Chwastiak proposed a mesophase-producing process wherein a single phase product resulted. The process requires both agitation and an inert gas sparge, the improvement resulting, according to Chwastiak, by passing the inert gas through the pitch at a rate of at least 4 standard cubic feet per hour (SCFH) per pound of pitch. In the illustration the heat treatment required 44 hours. It would be advantageous therefore to provide a process which did not require such a high rate of inert gas flow and which also could be accomplished in less time without deleteriously affecting the pitch product.

In published German Patent Application No. 3305-055-A (Nippon Oil KK) there is disclosed a process wherein a pitch feed is initially heat treated at 370° to 420° C. in a stream of inert gas for 5 to 20 hours under atmospheric or reduced pressure. Subsequently, an oxidant gas such as air or oxygen is passed through the pitch at 200°-350° C., one atmosphere pressure, at a flow rate of 1.0 to 3.5 SCFH for 10 minutes to 2 hours. No increase in mesophase content was reported as a result of the separate treatment with the oxidant gas.

Koppers Co. Inc. has published DT No. 2221707-Q and DT No. 2357477 patent applications, which disclose manufacture of isotropic carbon fibers wherein the starting material is first reacted with oxygen and then vacuum distilled, to remove non-oxidized lower-boiling components.

SUMMARY OF THE INVENTION

In accordance with the present invention, it has now been found that if a gas or gas mixture containing an effective, but not excessive, amount of an oxidatively reactive gas is sparged through a carbonaceous feedstock during heat soaking thereof, a pitch product containing 50 to 100% by volume mesophase, as determined by its optical anisotropy, results, and in a shorter time than would be required without the reactive gas component. This product, often substantially 100% mesophase, has a melting point suitable for fiber spinning and results in fibers having improved strength and elongation properties.

Thus, it is essential in the invention to use an oxidative component in the sparging gas stream, and furthermore to control the reactivity of the sparging gas such that its reactive component can promote the transformation to mesophase, without producing an unacceptably high melting point pitch product. At the same time, the sparging gas removes from the feed material volatile components that are known to be undesirable in a mesophase pitch product used for the manufacture of carbon fibers. In addition, the use of the sparging gas containing controlled amounts of an oxidative component further appears to affect the chemical and physical nature of the mesophase pitch product in such a manner that carbon fibers spun therefrom are characterized by outstanding modulus of elasticity and high tensile strength as well as an improved elongation ratio.

BRIEF DESCRIPTION OF THE DRAWING

FIG. 1 is a graph of heat soak time versus the amount of oxygen in the sparging gas utilizing a fluid catalytic cracker (FCC) heavy oil feedstock under a fixed set of conditions.

DETAILED DESCRIPTION OF THE INVENTION

The term "pitch" as used herein means petroleum pitches, natural asphalt and heavy oil obtained as a by-product in the naphtha cracking industry, pitches of high carbon content obtained from petroleum asphalt and other substances having properties of pitches produced as by-products in various industrial production processes.

The term "petroleum pitch" refers to the residuum carbonaceous material obtained from the thermal and catalytic cracking of petroleum distillates.

Generally, pitches having a high degree of aromaticity are suitable for carrying out the present invention.

Carbonaceous pitches having an aromatic carbon content of from about 75% to about 90% as determined by nuclear magnetic resonance spectroscopy are particularly useful in the process of this invention. So, too, are high boiling, highly aromatic streams containing such pitches or that are capable of being converted into such pitches.

On a weight basis, the useful pitches will have from about 88% to about 93% carbon and from about 7% to about 5% hydrogen. While elements other than carbon and hydrogen, such as sulfur and nitrogen, to mention a few, are normally present in such pitches, it is important that these other elements do not exceed about 4% by weight of the pitch. Also, these useful pitches typically will have an average molecular weight of the order of about 200 to 1,000.

Those petroleum pitches meeting the foregoing requirements are preferred starting materials for the practice of the present invention. Thus, it should be apparent that carbonaceous residues of petroleum origin, and particularly isotropic carbonaceous petroleum pitches which are known to form mesophase in substantial amounts, for example in the order of about 90% by volume and higher, during heat treatment at elevated temperatures, for example in the range of 350° C. to 450° C., are especially preferred starting materials for the practice of the present invention.

In general, any petroleum or coal-derived heavy hydrocarbon fraction may be used as the carbonaceous feedstock in the process of this invention. Suitable feedstocks in addition to petroleum pitch include heavy aromatic petroleum streams, ethylene cracker tars, coal derivatives, petroleum thermal tars, fluid catalytic cracker residues, and aromatic distillates having a boiling range of from 344°-510° C. The use of petroleum pitch-type feed is preferred.

The preferred sparging gas comprises an inert component which is a gas or a mixture of gases which do not react with the feedstock at the heat soaking temperature and an oxidatively reactive gas or mixture of gases present in an amount effective to promote formation of mesophase but less than that amount which produces mesophase pitch having a melting point above about 400° C., and preferably less than that amount which produces mesophase pitch having a melting point above about 360° C. Mesophase pitch having a melting point above about 360° C. is difficult to spin due to coke formation, and mesophase pitch melting above about 400° C. is virtually impossible to spin. An especially preferred sparging gas is nitrogen containing from 0.1 to 2.0 percent by volume oxygen.

Gases other than oxygen, such as ozone, hydrogen peroxide, nitrogen dioxide, formic acid vapor and hydrogen chloride vapor, may be used as the oxidative component. The amounts thereof would need to be selected to have an oxidative reactivity for the mesophase forming feed equivalent to that provided by using from 0.1 to 2.0 percent by volume oxygen in inert gas.

The inert gaseous component of the sparging gas is a gas or mixture of gases which do not react with the feedstock at heat soaking conditions. Illustrative inert gases are nitrogen, argon, xenon, helium, methane, hydrocarbon-based flue gas, steam, and mixtures thereof. In general, there can be employed any gas stream or a mixture of various gas streams with an appropriate oxidative component so that reaction with the feedstock or promotion of the reaction between molecules in feedstock occurs. It is essential, however, that the reactive gas used for sparging reacts directly or indirectly, i.e. catalytically, with the feedstock to produce a mesophase pitch which has an increased mesophase content and which can be spun into high quality carbon fibers.

The sparging gas rate will be at least 0.1 SCFH per pound of feed, preferably from about 0.1 to 20 SCFH. Sparging is generally carried out at atmospheric or slightly elevated pressures, e.g. about 1 to 3 atmospheres. The sparging time period may vary widely depending on the feedstock, gas feed rates, and the like. For most purposes it will be carried out throughout the heat treatment or heat-soaking step, which often ranges from about 2 to 100 hours, but in some cases the oxidative component may be added for less than the full reaction period. As discussed above, the essential feature of the present invention is the use of a sparging gas containing a controlled amount of an oxidative component during the heat-soaking of the carbonaceous feedstock to form a pitch containing 50 to 100% by volume mesophase, as determined by its optical anisotropy. Thus, the sparge gas of the present invention promotes formation of mesophase from isotropic feedstock, i.e. the amount of mesophase increases to the desired range in a shorter period of time, while at the same time the sparging gas carries away volatile materials which are undesirable. Further, the resulting mesophase is readily converted into carbon fibers with improved properties when compared with mesophase produced at similar conditions but without use of an oxidatively reactive sparge gas component.

The mesophase pitch product of this invention may be spun into continuous anisotropic carbon fibers by conventional procedures such as melt spinning, followed by the separate steps of thermosetting and carbonization. As indicated, these are known techniques and consequently they do not constitute critical features of the present invention.

The present invention will be more fully understood by reference to the following illustrative embodiments.

EXAMPLE 1

A series of mesophase pitches was made from the heavy residual fraction (482° C.+ fraction) of a heavy oil from an FCC unit by heat soaking at 385° C. and atmospheric pressure using a mixture of oxygen and nitrogen gas for sparging. Approximately 200 grams of the heavy residual oil was charged in a glass reactor with capacity around 340 ml for the heat soak step. Gas sparging through the reactor charge was controlled at 1.75 SCFH throughout the heat-soak step. The oxygen concentration in the sparging gas varied between 0.01 to 2.0 percent by volume. The melting temperatures and the mesophase contents of the product pitches were determined by hot-stage microscopy. Table 1 shows the yields and properties of the mesophase pitches.

TABLE 1

| PROCESSING CONDITIONS | | | PRODUCT PROPERTIES | | | |
|---|---|---|---|---|---|---|
| Temp. °C. | Time, hr | Oxygen Conc. in Sparging Gas, Vol. % | Product Yield, Wt. % | Melting Temp, °C. | Mesophase Cont., % | Product Mesophase Sample |
| 385 | 32 | 0.005 | — | 307 | 100 | A |
| 385 | 32 | 0.01 | 34.1 | 314 | 100 | B |
| 385 | 32 | 0.1 | 34.7 | 323 | 100 | C |
| 385 | 22 | 1.0 | 43.3 | 341 | 100 | D |

TABLE 1-continued

| PROCESSING CONDITIONS | | | PRODUCT PROPERTIES | | | |
|---|---|---|---|---|---|---|
| Temp. °C. | Time, hr | Oxygen Conc. in Sparging Gas, Vol. % | Product Yield, Wt. % | Melting Temp, °C. | Mesophase Cont., % | Product Mesophase Sample |
| 385 | 16 | 2.0 | 43.0 | 347 | 100 | E |

It is seen in Table 1 that the time required to produce 100% mesophase pitch is reduced and the product mesophase pitch yield is increased, as the amount of oxygen in the sparging gas is increased. The mesophase pitches A, B, C, D and E were then spun into fiber filaments through a single hole spinneret. The as-spun fiber filaments were placed in an oven and heated in air from room temperature to 350° C. at a rate of 4° C./minute and then heated at 350° C. for 32 minutes, followed by carbonization in argon at a temperature of 1950° C. The carbonized fibers were then tested as single filaments at a 2.54 cm gauge length and 10% elongation per minute. Table 2 shows the properties of the produced carbonized fibers.

TABLE 2

| Properties of Produced Carbon Fibers | | | |
|---|---|---|---|
| Mesophase Pitch Sample | Tensile Strength, $\times 10^3$ psi | Modulus, $\times 10^6$ psi | Elongation Ratio, % |
| A | 329 | 45 | 0.68 |
| B | 300 | 46 | 0.67 |
| C | 405 | 37 | 0.93 |
| D | 357 | 39 | 0.84 |
| E | 359 | 36 | 0.83 |

The results in Table 2 show that the fibers made from mesophase pitch prepared by adding a controlled amount of oxygen to the nitrogen sparging gas have higher elongation ratios than those made using high purity nitrogen (≦0.01 Vol. % oxygen) for sparging.

EXAMPLE 2

A series of mesophase pitches were made from heavy residual fractions of heavy oils from an FCC unit. The reactor system and the operating conditions for heat soak are essentially the same as those described in the previous Example 1. In addition to the gas sparging through the reactor charge, a flow of high purity nitrogen containing less than 0.001 Vol % oxygen was continuously purged through the open space underneath the reactor roof into the reactor overhead line at a rate of 1.75 SCFH. This purging step blanketed the top portion of the reactor with inert gas. The properties of the produced mesophase pitches are shown in Table 3.

TABLE 3

| | REACTION CONDITIONS | | | PRODUCT PROPERTIES | | | |
|---|---|---|---|---|---|---|---|
| Feed | Temp, °C. | Time, hr | $O_2$ Conc. in Sparging Gas, Vol % | Product Yield, Wt % | Melting Temp, °C. | Mesophase Content, % | Product I.D. |
| FCC Heavy Oil I | 385 | 32 | <0.005 | 32.1 | 318 | 100 | A' |
| FCC Heavy Oil I | 385 | 24 | 0.5 | 36.8 | 313 | 100 | B' |
| FCC Heavy Oil II | 385 | 30 | <0.005 | — | 304 | 100 | C' |
| FCC Heavy Oil II | 385 | 25 | 0.2 | — | 291 | 95 | D' |

The above produced mesophase pitches were then spun into fibers followed by stabilization in the same way as described in Example 1. The fibers were then carbonized to 1800° C. Table 4 shows the properties of the produced carbon fibers.

TABLE 4

| Properties of Produced Carbon Fibers | | | |
|---|---|---|---|
| Mesophase Pitch Sample | Tensile Strength, $\times 10^3$ psig | Modulus $\times 10^6$ psi | Elongation Ratio, % |
| A' | 316 | 34 | 0.92 |
| B' | 329 | 24 | 1.17 |
| C' | 401 | 50 | 0.73 |
| D' | 397 | 32 | 1.16 |

The results in Table 4 again demonstrate the enhancement of the elongation ratio of product fibers by adding a controlled amount of oxygen in the sparging gas.

Referring to FIG. 1, the data show that when a sparge gas containing controlled amounts of oxygen as the oxidative component is employed, there is a significant reduction in the time necessary to convert the feedstock to a mesophase pitch suitable for carbon fiber production. Although the precise reason for this is not known for certain, it is believed that the reactive or oxidative component in the sparging gas reacts with aromatic molecules in the feed to form some type of free radicals which then lead to a higher degree of polymerization via free radical chain reaction.

Various changes and modifications can be made in the process of this invention without departing from the spirit and scope thereof. The various embodiments which have been described herein are for the purpose of illustrating the invention, and are not intended to limit it.

What is claimed is:

1. In a process for producing a pitch product having a mesophase content of from 50 to 100% by volume and suitable for carbon fiber manufacture, which process comprises heating a carbonaceous feedstock at mesophase-forming temperature while passing a sparging gas therethrough for a time sufficient to produce said pitch product having said mesophase content, the improvement wherein said sparging gas includes an oxidatively reactive gaseous component in an amount (a) sufficient to produce said amount of mesophase content in a shorter time than would be required without said oxidatively reactive gaseous component, and (b) less than that amount which produces a pitch product having a melting point above 400° C. wherein the oxidative reactive gaseous component is selected from the group consisting of oxygen, ozone, hydrogen peroxide, formic acid vapor, hydrogen chloride vapor and mixtures thereof, and wherein sufficient oxidative reactivity is present to equal from 0.1 to 2.0 percent by volume oxygen in the sparge gas.

2. The process of claim 1 wherein said pitch product is substantially 100 percent mesophase with a melting point not greater than 360° C.

3. The process of claim 1 wherein said feedstock is heated at a temperature ranging from about 350° C. to 450° C. for a time of from 2 to 100 hours and said sparging gas consists essentially of from 0.1 to 2.0 volume percent oxygen with the balance being inert, said sparging gas being introduced at a rate of from 0.1 to 20 SCFH per pound of feedstock.

4. A process for producing an anisotropic pitch having a mesophase content of from 50 to 100% and suitable for carbon fiber manufacture, which process comprises heating a carbonaceous feedstock at a temperature ranging from about 350° to 450° C. to produce mesophase while passing a sparging gas through said feedstock at a rate of at least 0.1 SCFH per pound of feedstock, said sparging gas comprising an oxidatively reactive gaseous component in an amount effective to promote formation of said mesophase, wherein the sparge gas contains an oxidative reactive gaseous component selected from the group consisting of oxygen, ozone, hydrogen peroxide, formic acid vapor, hydrogen chloride vapor and mixtures thereof, and wherein sufficient oxidative reactivity is present to equal from 0.1 to 2.0 percent by volume oxygen in the sparge gas.

5. The process of claim 4 wherein said feedstock is a pitch.

6. The process of claim 4 wherein said anisotropic pitch product contains from about 90 to 100% mesophase.

7. The process of claim 4 wherein said sparging gas consists essentially of said reactive gaseous component and an inert gas selected from the group consisting of nitrogen, argon, xenon, helium, methane, hydrocarbon-based flue gas, steam, and mixtures thereof.

8. The process of claim 7 wherein said inert gas is nitrogen.

9. The process of claim 7 wherein the sparging gas rate ranges from about 0.1 to 20 SCFH per pound of feedstock.

10. In a process for preparing a mesophase pitch product comprising passing a sparging gas through a carbonaceous feedstock which is being heated at elevated temperatures to produce mesophase pitch, the improvement which comprises utilizing a sparging gas comprising an oxidative reactive component selected from the group consisting of oxygen, ozone, hydrogen peroxide, formic acid vapor, hydrogen chloride vapor, and mixtures thereof and wherein sufficient oxidative reactivity is present to be equal to 0.1 to 2.0 volume percent oxygen in the sparge gas to produce an anisotropic pitch product having from 50 to 100% mesophase and suitable for the manufacture of carbon fibers having high tensile strength.

11. The process of claim 10 wherein said oxidatively reactive component is oxygen.

12. The process of claim 11 wherein the remainder of said sparging gas is nitrogen.

13. The process of claim 1 wherein said feedstock is petroleum pitch.

14. The process of claim 4 wherein said feedstock is petroleum pitch.

15. The process of claim 10 wherein said feedstock is petroleum pitch.

* * * * *